United States Patent [19]

Marzoli

[11] 4,040,145

[45] Aug. 9, 1977

[54] MACHINE FOR LOOSENING AND REMOVING TEXTILE FIBERS FROM FIBER BALES

[75] Inventor: Angelo Marzoli, Bergamo, Italy

[73] Assignee: F. lli Marzoli & C. S.p.A., Palazzolo Sull'Oglio, Italy

[21] Appl. No.: 687,601

[22] Filed: May 18, 1976

[30] Foreign Application Priority Data

May 21, 1975 Italy ..... 23584/75

[51] Int. Cl.[2] ..... D01G 7/06

[52] U.S. Cl. ..... 19/81

[58] Field of Search ..... 19/80 R, 81, 145.5; 214/17 D; 142/101 A

[56] References Cited

U.S. PATENT DOCUMENTS

| | | | |
|---|---|---|---|
| 2,509,823 | 5/1950 | Hughes | 19/80 R |
| 3,251,095 | 5/1966 | Cadenhead | 19/80 R |
| 3,736,624 | 6/1973 | Alt et al. | 19/80 R |

FOREIGN PATENT DOCUMENTS

| | | | |
|---|---|---|---|
| 1,132,871 | 11/1968 | United Kingdom | 19/80 R |

*Primary Examiner*—Dorsey Newton

[57] ABSTRACT

A machine for loosening and withdrawing fibers from a fiber bale, wherein bars are provided for engaging the top surface of the bale and, when depressed along a certain preselected distance, act in such a way that the carding cloth is active upon a limited thickness zone of the bale.

8 Claims, 4 Drawing Figures

MACHINE FOR LOOSENING AND REMOVING TEXTILE FIBERS FROM FIBER BALES

FIELD OF THE INVENTION

This invention relates to an apparatus for loosening and removing textile fibres from bales, of the kind in which a movable carding cloth is brought into contact with the top surface of a bale of textile fibres.

BACKGROUND

Machines of this kind are known, which comprise a framing adapted to contain at least one bale, and a carriage, guided to slide both vertically and horizontally in the framing and carrying the carding cloth, the latter being driven in rotation by a motor mounted on the carriage in question. In the vicinity of the outlet end of the carding cloth there is mounted, on the carriage itself and parallel to the actuating and supporting rollers for the carding cloth, a loosening cylinder which is adapted to transfer the fibres withdrawn by the carding cloth to a conveyor belt which is arranged also in the framing. The conveyor belt transfers the fibres to the preparatory stages for spinning.

The engagement of the bottom lap of the carding cloth with the upper lap of the bale causes a fibre loosening which is only seemingly restricted by the active surface of the card cloth.

However, on account of the fact that the bales are formed by pressed fibres of irregular quality and having an uneven density, the detachment of the fibres from the bales takes place in lumps and tangles of different sizes so that fibres are also withdrawn which are outside said active surface of the carding cloth.

Inasmuch as the fibre bales are compressed lapwise, there is also the danger that the carding cloth may loosen parts of laps of the same bale and this, of course, would prejudice the regular operation of the machines which follow or cause jammings. In other cases, conversely, due to the presence of said lumps, entanglements and so forth, the percentage of one of the components of the fibre mix obtained could be altered, the result being a worsening of the quality of the end product.

SUMMARY OF THE INVENTION

An object of this invention is to prevent the dangers enumerated above while providing a machine of the kind referred to above which is capable of ensuring a regular and even loosening of the fibres from the bales in such a way that the fibres cannot clog the machines which follow, the fibres being removed at a virtually constant rate of flow.

This object is achieved, according to the invention by a machine of the kind referred to above in which a carriage which supports a carding cloth is guided both vertically and horizontally in the machine framing to contact the top face of a bale arranged beneath the framing, actuating means mounted on the framing controlling the horizontal and vertical movement of the carriage and actuating means arranged on the carriage driving the carding cloth in rotation, the machine being characterized in that from the carriage extend, at the side of the carding cloth, bars which are brought to an appropriate distance under the active surface of the carding cloth in order to engage the upper lap of the bale, when the active surface of the card contacts the top lap of the bale, said bars being substantially parallel to the active surface of the card and arranged crosswise relative to the direction of rotation of the carding cloth.

In a preferred embodiment of the invention, on each of the two sides of the carding cloth on the carriage a conveying cylinder is mounted, which is driven in rotation so as to convey the fibres towards the card, the conveying cylinder having metal spikes projecting between the bars and being actuated by motive means arranged on the carriage.

BRIEF DESCRIPTION OF THE DRAWINGS

Further features and advantages of the machine according to the invention will become apparent from the ensuing description of an embodiment thereof as shown in the accompanying drawings, wherein.

DETAILED DESCRIPTION

Figure 1:
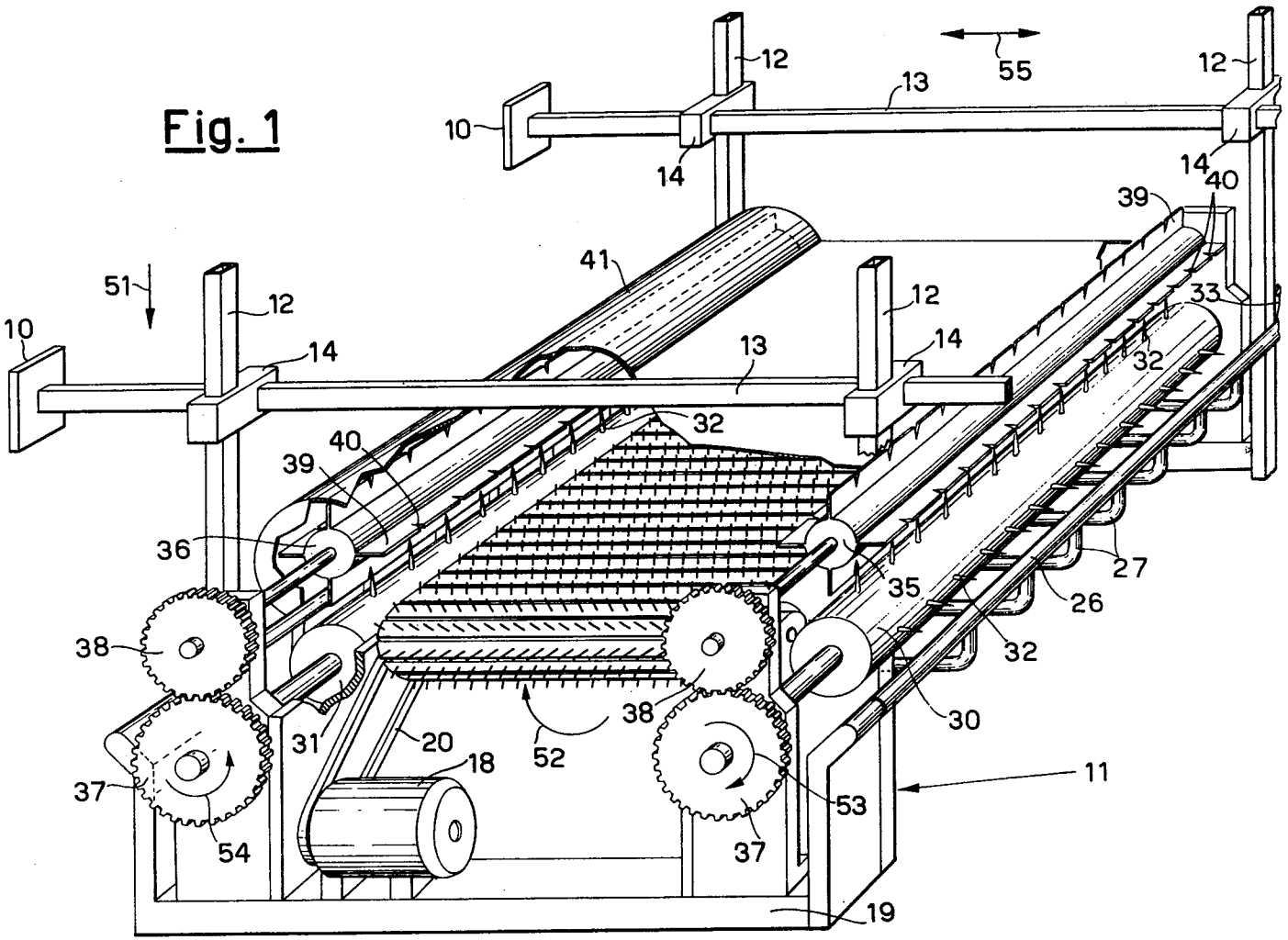
FIG. 1 is a perspective view, partly fragmentary, of the machine according to the invention.

The machine according to the invention comprises a framing 10 and a carriage 11, the latter being driven to slide within the framing 10 by means of vertical guides 12 and horizontal guides 13, these guides being mutually connected by joints 14.

Figure 3:
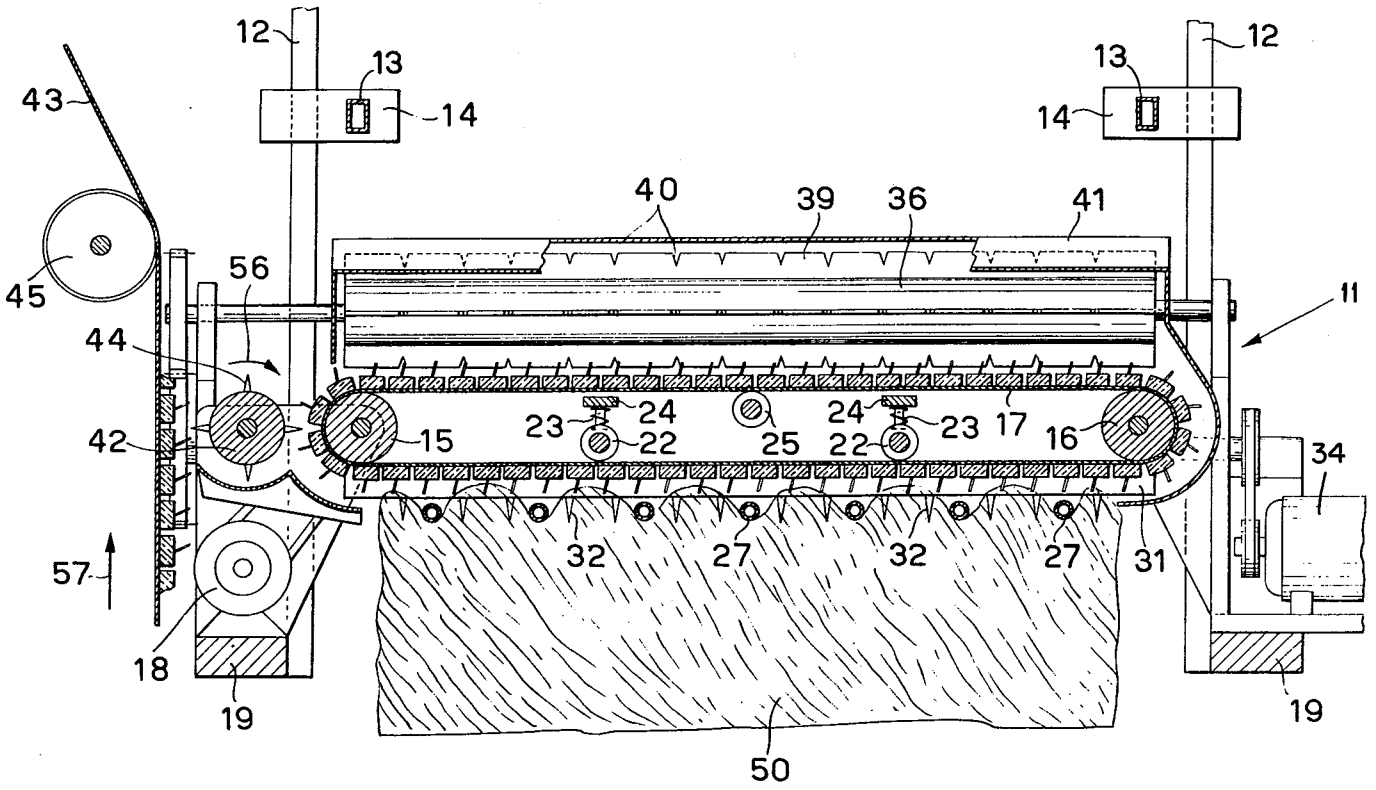
FIG. 3 is a cross-sectional view, taken along line III—III in FIG. 2.

The guides 12 support the carriage 11 and are properly actuable by motive means of conventional construction and not shown herein. On the carriage 11 there is supported for rotation by rollers 15 and 16 (FIG. 3) a carding cloth 17. A motor 18, mounted on the framing 19 of the carriage 11 is mechanically connected through a driving belt 20 to the roller 15. Between the two laps of the card cloth 17 there are active, on the lower lap, wheeles 22 which are resiliently supported at 23 by supporting members 24 affixed to the frame 19; the upper lap, conversely, is borne by a roller 25 which is supported for rotation by the framing 19.

The framing 19 carries, at each side of the carding cloth 17, a rod 26 which extends along the direction of motion of the cloth 17. The two rods 26 are at a level which is higher than that of the lower lap of the cloth 17: to each of these rods is affixed a plurality of bars 27 which extend beneath the lower lap of the cloth 17. The bars 27 are at a small distance from the teeth of the carding cloth 17 and are substantially parallel to the cloth. The bars, in addition, are parallel to each other and perpendicular, in the example shown, to the direction of motion of the cloth 17.

Figure 4:
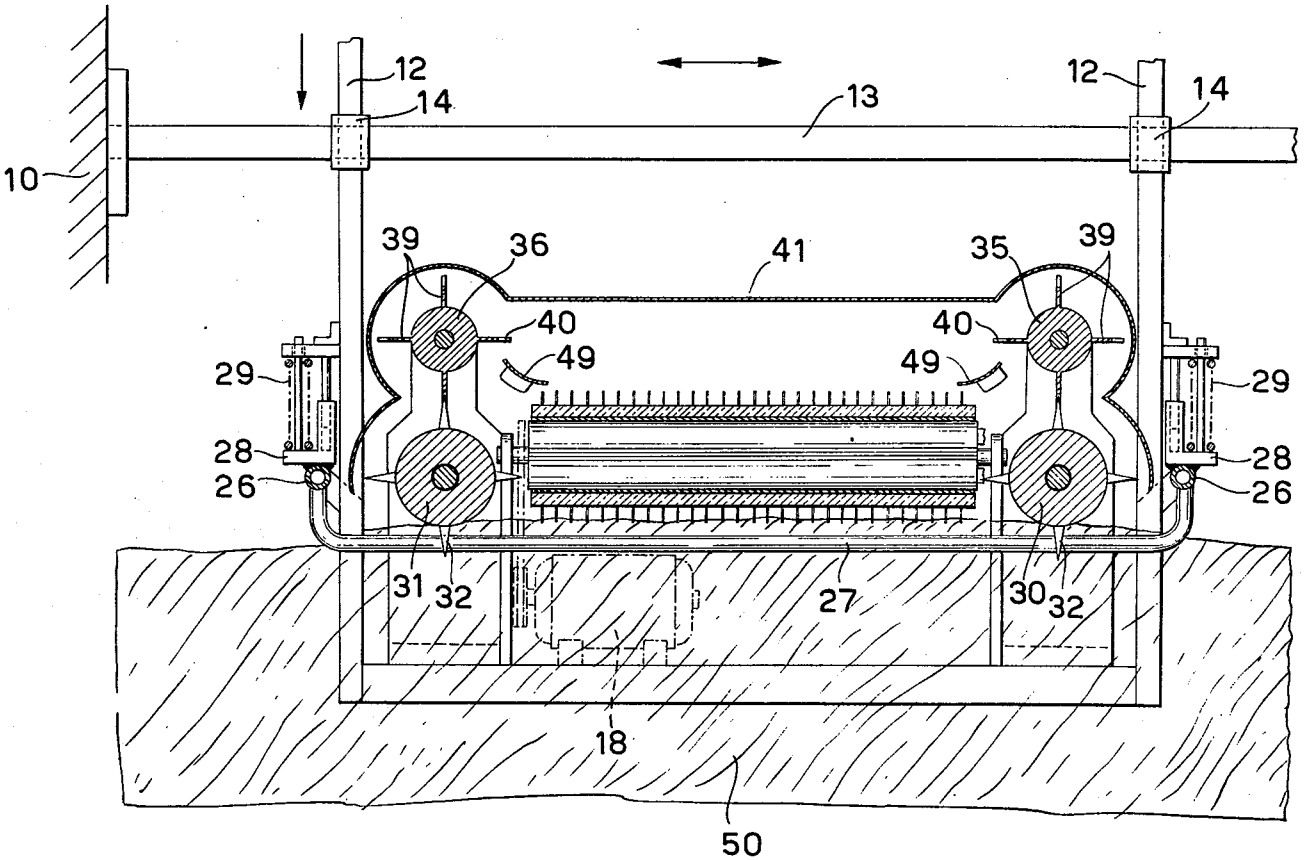
FIG. 4 is a cross-sectional view, taken along line IV—IV in FIG. 2.

The rods 26, as viewed in FIG. 4, are connected to the framing 19 through a supporting member 28 which is vertically displaceable and is biased by a spring 29 (FIG. 4).

On each side of the cloth 17 in the framing 19, in addition, there is, supported for rotation, a conveying cylinder 30, 31 with metal spikes 32. The cylinders 30, 31 is extended parallel to the direction of motion of the cloth 17 and are arranged with their axes above the bars 27: the metal spikes 32 project beneath the bars 27 and between these latter.

Figure 2:
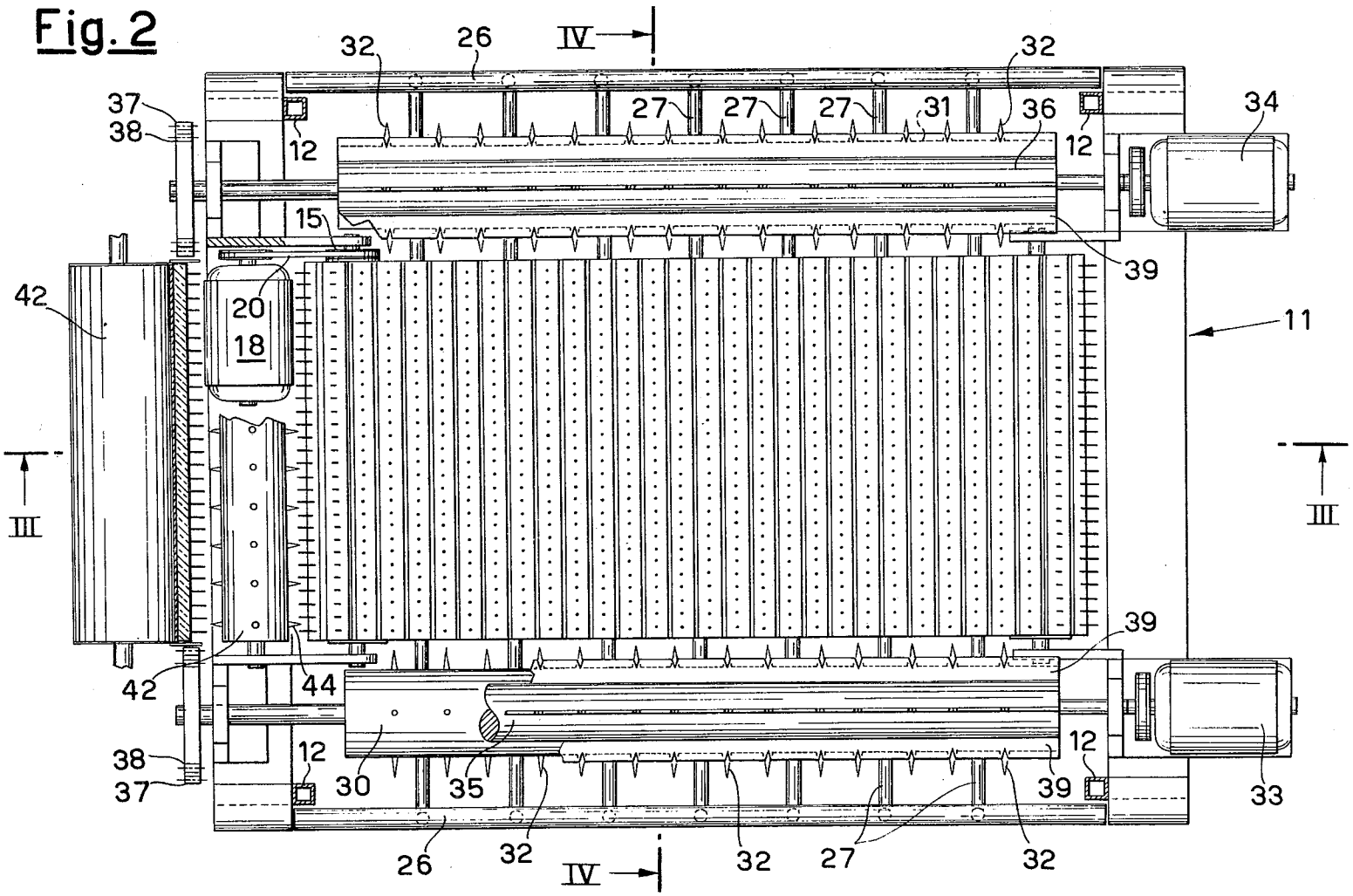
FIG. 2 is a top plan view, partly in cross-section, of the machine shown in FIG. 1.

As viewed in FIG. 2, the cylinders 30, 31 can be actuated by motors 33 and 34. The cylinders 30 and 31 drive, in turn, loosening cylinders 35 and 36, mechanically connected to the former cylinders by gears 37 and 38. The loosening cylinders 35 and 35 are mounted on the frame 19 above the cylinders 30 and 31 and have ridges 39 with notches 40, through which the metal spikes 32 are swept.

The framing 19 is covered, both laterally and at its top by a sheet metal apron 41. Baffles 49 are arranged on the framing 19 between the cylinder 30, 31 and the upper lap of the carding cloth.

On the outlet side of the cloth 17 on the carriage 11 there is, in addition, mounted for rotation, a loosening cylinder 42 which is confrontingly parallel to the roller 15 of the carding cloth 17. The cylinder 42 is driven by an appropriate motive means, not shown. The cylinder 42 is confrontingly mounted, with its metal spikes 44, relative to a vertical conveyor belt 43: the latter belt is borne at 45 and is not shown in its constructional details, inasmuch as it is conventional.

The operation of the machine according to the intion is as follows.

Let it be assumed that in the framing 10, beneath the carriage 11, a fibre bale 50 is arranged, having a width which is substantially equal to the longitudinal extension and any desired length.

To loosen and remove the fibres from the bale 50, the carriage 11 is lowered in the direction of arrow 51, whereas the cloth 17 is driven by the motor 18 in the direction of arrow 52. The motor 33 drives the cylinder 30 in rotation in the direction of arrow 53 and the motor 34 drives the cylinder 31 in the direction of the arrow 54. Due to the provision of a higher drive-transfer ratio of either gear 37, 38, the loosening cylinders 35 and 36 are driven at a higher speed than that of the cylinders 30 and 31 and in a direction opposite to that of said latter cylinders.

Upon lowering of the carriage 11, the bars 27 are pressed against the top lap of the bale 50. The fibres, for example of cotton, of said bale lap thus take a wavelike shape in the direction of movement of the cloth 17. The raised portions of the fibres jutting from and between the bars 27 are thus capable of being presented to the spikes of the carding cloth 17, thus preventing lumps and tangles of fibres, or even bale lap portions, from being stripped from the bale by the agency of the carding cloth. The stripping of the bale lap portions is also obtained at the boundaries of the active surface of the cloth 17 due to the presence of the conveying cylinders 30, 31 which, during the translational motion of the carriage 11 in the direction of arrow 55, convey the fibres towards the cloth 17. Fibres which have possibly been deposited on the metal spikes 32 of the conveying cylinders 30 and 31 are stripped by the loosening cylinders 35 and 36 and sent to the upper lap of the cloth 17 again. Both the fibres loosened from the cylinders 30, 31 and those stripped by the teeth of the carding cloth 17 are then removed by the latter. At the outlet of the cloth 17, the fibres are then removed by the loosening cylinder 42 which, by its being rotated in the direction of arrow 56, transfers the fibres to the conveyor belt 43 which is driven in the direction of the arrow 57.

The fibres are thus taken in an approximately constant amount from the bale 50. For the above reasons, clogging is also prevented in machines downstream of the machine according to the invention and the fibres are substantially untangled from one another.

Thus, the fibres are removed in metered quantities which are almost exclusively a function of the weight of the carriage, the speeds of rotation of the carding cloth and the conveying cylinders: these influencing factors can all be adjusted over a wide range of magnitude.

Needless to say, the machine according to the invention could also be differently embodied. The bars which are adapted to be pressed into the fibre bale could, for example, be also inclined relative to the direction of rotation of the carding cloth. Thus, two carding cloths could be placed side by side with the same arrangement of the pressing bars and the loosening cylinders.

What I claim is:

1. An apparatus for loosening and removing textile fibres from bales, said apparatus comprising a framing adapted to contain at least one fibre bale, a carriage supported from said framing with means for vertical and horizontal translation movement for movement relative to said bale, a driven carding cloth mounted on said carriage, said cloth having upper and lower traveling laps and lateral edges, bars on said carriage extending below said carding cloth, said bale having a top surface engaged by said bars when the carriage is lowered, said carding cloth having an active surface for contacting said top surface of the bale and removing fibres therefrom when the carriage is lowered and the bars engage the bale, said bars extending substantially parallel to said active surface of the carding cloth and arranged crosswise relative to the direction of travel of the laps of the carding cloth, conveying cylinder means on said carriage on each side of the carding cloth for removing fibres from said bale and bringing the fibres onto the upper lap of the carding cloth upon horizontal movement of the carriage, motor means for driving said conveying cylinder means in rotation for bringing the fibers removed from said bale onto the upper lap of the carding cloth, each said conveying cylinder means including a conveying cylinder with metal spikes projecting between said bars; and means for removing fibre from said carding cloth.

2. An apparatus according to claim 1 wherein said bars extend perpendicularly to the direction of travel of the laps of the carding cloth.

3. An apparatus according to claim 1 comprising rods on said carriage extending along the lateral edges of said carding cloth and supporting said bars.

4. An apparatus according to claim 3 comprising resiliently yielding support members supporting said rods from said carriage.

5. An apparatus according to claim 1 comprising rollers supported from said carriage and extending between said laps of the carding cloth perpendicular to the direction of travel of the laps of said cloth and means resiliently biassing the rollers in contact with the lower lap of the carding cloth.

6. An apparatus according to claim 1 wherein said conveying cylinder means further includes loosening cylinders on said carriage cooperating with said conveying cylinders for conveying fibres loosened by the conveying cylinders to the upper lap of the carding cloth.

7. An apparatus according to claim 6 comprising means drivingly connecting said loosening cylinders and said conveying cylinders.

8. An apparatus according to claim 1 wherein said bars are spaced at a distance from one another to cause the top surface of the bale to assume a wave shape when said bars are pressed into said bale when the carriage is lowered, said carding cloth including teeth on said active surface for combing the waves of the bale.

* * * * *